US006920885B2

(12) United States Patent
Braun

(10) Patent No.: US 6,920,885 B2
(45) Date of Patent: Jul. 26, 2005

(54) CIGARETTE HOLDING DEVICE

(75) Inventor: Peter Braun, Hamden, CT (US)

(73) Assignee: Rasco Braun, LLC, Branford, CT (US)

( * ) Notice: Subject to any disclaimer, the term of this patent is extended or adjusted under 35 U.S.C. 154(b) by 0 days.

(21) Appl. No.: 10/040,146

(22) Filed: Jan. 3, 2002

(65) Prior Publication Data

US 2002/0083952 A1 Jul. 4, 2002

Related U.S. Application Data

(60) Provisional application No. 60/259,456, filed on Jan. 3, 2001.

(51) Int. Cl.[7] ..... A24F 13/18; A24F 47/00

(52) U.S. Cl. ..... 131/256; 131/235.1; 131/242

(58) Field of Search ..... 131/330, 175, 131/187, 191, 256, 235.1, 242, 240.1; 27/172, 183, 186

(56) References Cited

U.S. PATENT DOCUMENTS

| | | | | | |
|---|---|---|---|---|---|
| 3,336,929 | A | * | 8/1967 | Williams | 131/175 |
| 4,660,575 | A | * | 4/1987 | Andreason et al. | 131/256 |
| 4,809,715 | A | | 3/1989 | Musetti | |
| 6,273,094 | B1 | * | 8/2001 | Potter | 131/256 |
| 6,431,177 | B1 | * | 8/2002 | Sieggen et al. | 131/256 |
| 6,463,936 | B1 | * | 10/2002 | Hicks | 131/256 |

* cited by examiner

*Primary Examiner*—Steven P. Griffin
*Assistant Examiner*—Carlos Lopez
(74) *Attorney, Agent, or Firm*—Bachman & LaPointe PC

(57) ABSTRACT

An apparatus and method for reducing or quitting use of smokers' articles is disclosed. The apparatus is a tube which can readily be used to extinguish and preserve partially-smoked cigarettes for later use. The method involves use of the apparatus to periodically cut back on cigarette use until an acceptable level is reached.

10 Claims, 1 Drawing Sheet

CIGARETTE HOLDING DEVICE

CROSS REFERENCE TO RELATED APPLICATION

This application claims the benefit of U.S. Provisional Application Ser. No. 60/259,456, Filed Jan. 3, 2001.

BACKGROUND OF THE INVENTION

The invention relates to an apparatus for holding cigarettes and other smokers articles and, more particularly, to a device for extinguishing and holding a partially used cigarette, and to methods for using the apparatus of the present invention, especially to a method for helping individuals reduce or stop the use of smokers articles containing addictive substances such as nicotine.

Smoking of cigarettes and other smokers articles is wide spread in and beyond the United States. The medical hazards of smoking and using nicotine products are extremely well documented, and countless efforts have been made to provide various approaches for reducing or quitting smoking.

Current commercial products include various methods of delivering substitutes for nicotine such as chewing gum, patches and the like. Such articles may frequently require a prescription, and also lead to repeat expenditures by consumers which can lead to extraordinary expense to the consumer.

Another commercial attempt at providing methods for quitting smoking includes attempts to change behavior through hypnosis, and the like, also which leads to substantial cost to the consumer.

Despite the foregoing attempts, and the substantial cost to consumers attempting to quit smoking, the vast majority of people attempting to reduce or quit smoking fail. It is believed that more than 16 million Americans have tried to quit smoking each year, with a success rate of about 8%. Further, those who eventually succeed in quitting have failed on average at lead 5 times on prior attempts.

In light of the foregoing, it is clear that the need remains for an effective means by which cigarette smokers can reduce or quit intake, without significant and repeat expense.

It is therefore the primary object of the present invention to provide an apparatus which is readily useable for reducing and quitting smoking.

It is a further object of the present invention to provide a method utilizing the apparatus for reducing or quitting smoking.

It is still a further object of the present invention to provide such an apparatus and method which are cost effective to the consumer.

Other objects and advantages will appear hereinbelow.

SUMMARY OF THE INVENTION

In accordance with the present invention, the foregoing objects and advantages have been readily attained.

According to the invention, an apparatus is provided for extinguishing and holding a partially-smoked cigarette. The apparatus comprises a tube having a diameter adapted to conform substantially to that of conventional cigarettes, and having one closed end and one open end. The tube advantageously is provided with a slightly reduced diameter portion sized to engage and hold a cigarette, and also to substantially sealingly engage the side wall of the cigarette so that the burning portion of the cigarette is enclosed in a substantially sealed area so as to extinguish same.

The open end of the apparatus preferably has an open edge which is angled so as to provide a long-wall portion and a short-wall portion whereby the long-wall portion protects the full length of the cigarette and the short-wall portion allows access to a portion of the cigarette for use in removing the cigarette from the tube. The tube may also advantageously be provided with a clip or other structure for use in securing the apparatus within a pocket or the like by a user.

The apparatus can be made from any suitable material, with the tube preferably being made of a metal or other material which is not damaged or adversely impacted by the burning portion of the cigarette. The tube should also be durable so as to resist bending or crushing.

When used, the ash-portion of the cigarette tip hardens as the cigarette is extinguished, and keeps the remainder of the cigarette fresh for later use. When it is desired to re-light the cigarette, the cigarette can be easily removed from the tube, the hardened ash can be shaken free and fresh clean tobacco is then exposed for re-lighting.

In accordance with the present invention, a method is also provided for using the tube of the present invention to reduce or quit smoking. In accordance with the broad scope of the method of the present invention, the apparatus of the present invention is used to extinguish and save a cigarette, before it is finished, for later use. Cigarette use is also carefully monitored while doing so, and behavior modification leading to reduction in smoking results.

It is well documented that the initial two or three puffs or inhalations of a cigarette satisfies the immediate need for nicotine when addicted. By using the apparatus of the present invention, this initial need is satisfied and the cigarette can be extinguished and saved without the user feeling as though the cigarette has been wasted. This in itself can help a user significantly cut back on cigarette use in the course of a day.

In accordance with a further aspect of the method of the present invention, a user determines an initial amount of cigarettes corresponding to an average periodical consumption. The user then carefully documents the progressive reduction in cigarettes smoked while utilizing the apparatus of the present invention until cigarette use is stopped or reaches a level satisfactory to the user.

BRIEF DESCRIPTION OF DRAWINGS

A detailed description of preferred embodiments of the present invention follows, with reference to the attached drawings, wherein.

DETAILED DESCRIPTION

Figure 1:
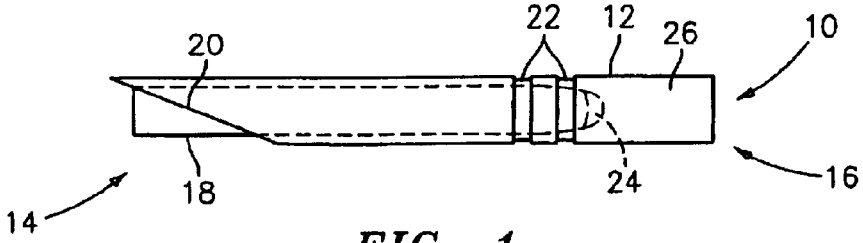
FIG. 1 is a side view of an apparatus in accordance with the present invention.
Figure 2:
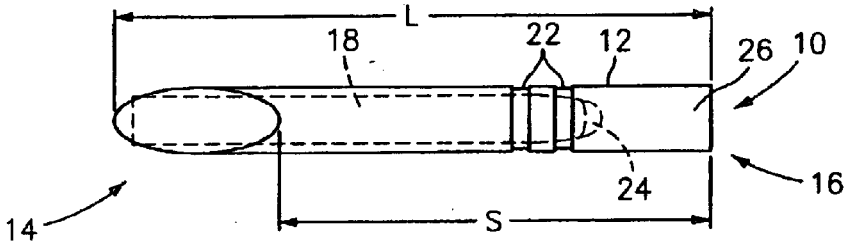
FIG. 2 is another side view of an apparatus in accordance with the present invention rotated 90° from that of FIG. 1.
Figure 3:
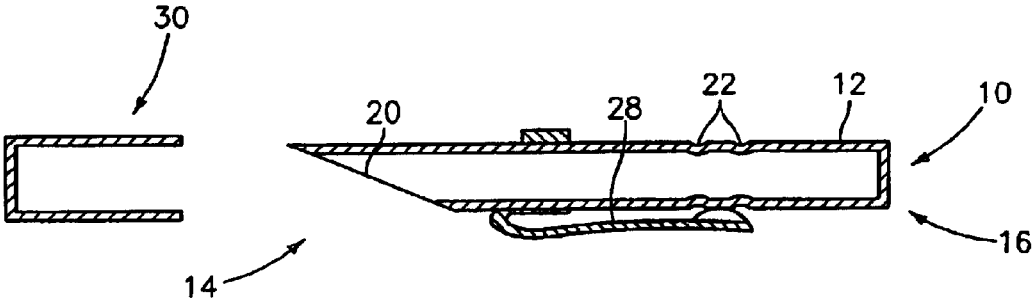
FIG. 3 is a sectional view corresponding to FIG. 1.

Referring to FIGS. 1–3, an apparatus 10 in accordance with the present invention is illustrated. Apparatus 10 preferably is provided as a tube 12 having an open end 14 and a closed end 16. Tube 12 preferably has a diameter, particularly an inside diameter, selected to snugly receive a conventionally-sized cigarette.

Closed end 16 may suitably be any type of integrally formed or assembled closed end portion, and closed end 16 is schematically illustrated in FIGS. 1–3. Closed end 16 may suitably be a plug sealed into the end of tube 12, or may be provided in any other form.

Open end 14 is left open to allow insertion of a cigarette 18. Open end 14 is preferably defined having a sloped edge 20 so as to define a long length L (FIG. 2) and a short length S. Long length L is preferably selected so as to provide sufficient length of tube 12 that cigarette 18, when inserted therein, is protected from crushing, bending, breaking and the like. Short length S is preferably selected so as to allow a cigarette to be easily removed. Thus, short length S preferably allows at least a ⅜ to ⅝ inch portion of cigarette 18 to be extending the beyond the edge at short length S, while nevertheless being shielded by long length L.

Tube 12 is also preferably further provided having at least one reduction in inside diameter, and the embodiment in FIGS. 1–3 has two bands 22 providing two reductions in diameter, which are sized to be sufficient to snugly engage the outside surface of a cigarette 18 disposed within tube 12. Bands 22 serve several functions. First, bands 22 serve to snugly hold cigarette 18 within tube 12 so as to avoid inadvertent removal of cigarette 18 from tube 12. Further, bands 22 serve to substantially sealingly engage the side wall of cigarette 18 such that the burning portion 24 of cigarette 12 is contained and substantially sealed within an area 26 defined by closed end 16, the inner side wall of tube 12 and the engagement between cigarette 18 and bands 22.

FIGS. 1–3 show bands 22 as being indentations in the outer wall of tube 12 which extend inwardly to engage cigarette 18 (see particularly FIG. 3). It should of course be appreciated that the important portion of this structure is the inwardly extending surfaces which reduce the inner diameter of tube 12, and that such structures could be otherwise positioned within tube 12 by other methods readily known to person of ordinary skill in the art.

FIG. 3 illustrates a further preferred embodiment of the present invention, wherein a pocket clip 28 is positioned on tube 12 for use in securing tube 12 to a pocket and the like. Other securement devices may be desirable as well so as to assist a user of apparatus 10 in not losing apparatus 10.

Tube 12 may advantageously be made of any material which will resist crushing, bending and the like. One suitable example of acceptable material is brass. Of course, other materials are acceptable as well. Tube 12 in accordance with the present invention may advantageously be provided having an outside diameter of approximately 9–10 mm, and an inside diameter of approximately 8.3–9.3 mm, with a wall thickness of about 0.6 mm. Further, long length L may suitably be about 80 mm, while short length S may suitable be about 60 mm. The angle of sloped edge 20 may advantageously be between about 15 and about 45° as measured with respect to the longitudinal axis of apparatus 10, more preferably about 25°.

Also as shown in FIG. 3, apparatus 10 in accordance with the present invention may suitably be provided with a cap 30 which is preferably sized to snugly engage open end 14 and to close tube 12 when positioned in place thereon. Cap 30 may suitably be made from the same material as tube 12, and preferably has a length sufficient to cover the entire opening of open end 14, and therefore preferably overlaps the short edge of sloped surface 20. Cap 30 may advantageously be used to help contain any odors and the like which may emanate from a cigarette after having been extinguished, and may further help to avoid debris and the like from escaping from within tube 12, so that tube 12 can be kept, for example, within a pocket, purse or other receptacle without allowing undesirable materials to escape therein.

Apparatus 10 in accordance with the present invention advantageously allows a partially-smoked cigarette 18 to be inserted into tube 12 whereby the burning portion 24 is rapidly extinguished and the cigarette 18 is safely kept for later use. Burning portion 24 when extinguished turns into a substantially hardened ash, which can easily be removed from cigarette 18 to expose fresh tobacco when and if it is desired to re-light the cigarette.

In accordance with the present invention, a method is also provided. In accordance with the method of the present invention, a cigarette user is guided through a reduction or complete stoppage of cigarette use.

In accordance with the method of the present invention, the user first selects a number of cigarettes for a particular period which corresponds to the user's average periodic use of cigarettes. For the sake of this description, the period will be considered to be one week. Of course, the method could be adapted so as to be accomplished in different periods such as days, week, months and the like.

Assuming a cigarette user uses X cigarettes per week, in accordance with the method of the present invention, the user divides X by 7 (the number of days in the period) to obtain the number of cigarettes per day that the user is allowed to smoke. When it is desired to smoke such cigarettes, the user smokes 2–3 puffs and then extinguishes the cigarette utilizing apparatus 10 of the present invention. By using apparatus 10, even for only a small number of cigarettes per day, one or more cigarettes will be remaining at the end of the day. This remaining cigarette or cigarettes is/are set aside.

The procedure is followed for each remaining day in the period, and at the end of the period, the unused and set aside cigarettes are counted. This is then used as a starting reduction in the number of cigarettes allowed for the next week. For example, if the user started the method with a weekly consumption of 49 cigarettes per week, and 7 cigarettes were set aside at the end of the first week, then the seven cigarettes are treated as the reduction in cigarette consumption for the beginning of the next week.

For the next week, the user again obtains the original number of cigarettes for the week (49 in this example), sets aside 7 of the starting 49, and again uses apparatus 10 to extinguish and re-use cigarettes through the course of each day.

By repeating this process, the user can either attempt to quit smoking all together, or reduce smoking to an acceptable level as considered by that user. It is believed that success rates in reducing or quitting smoking can be accomplished utilizing the method and apparatus of the present invention which will greatly exceed the average 8% success rate accomplished utilizing conventional devices and methods.

It should of course be appreciated that the above detailed description is given in terms of cigarette smoking. It should be appreciated that the apparatus and method of the present invention is useful in connection with any type of combustible smoker's articles, be they tobacco-based or otherwise, and the method and apparatus of the present invention can successfully assist users of such articles who are addicted to components therein in reducing or quitting all together such use.

It should therefore be readily appreciated that an apparatus and method have been provided which fully satisfy the stated objects of the present invention. Various modifications to parts, size, shape and/or form of the apparatus of the present invention can and will be readily apparent to the person of ordinary skill in the art, and are all considered as to fall within the scope of the present invention. This is also true as to minor modifications to the steps of the method of the present invention, and such minor modifications are considered to fall within the broad scope of the method of the present invention as well.

What is claimed:

1. A device for extinguishing and retaining a cigarette, comprising:

a tube having a closed end and an open end, said tube defining an inside diameter arranged and constructed to slidingly receive a cigarette, said tube further having a reduced inside diameter portion positioned between said closed end and said open end and arranged and constructed to sealingly engage said cigarette so as to extinguish a lighted tip of said cigarette when inserted past said reduced inside diameter portion, wherein said reduced inside diameter portion comprises at least two axially spaced circumferential bands extending inwardly from said inside diameter of said tube.

2. The apparatus of claim 1, wherein said reduced inside diameter portion, said closed end and a portion of said tube extending therebetween define an extinguishing area for extinguishing said lighted tip.

3. The apparatus of claim 2, wherein said inside diameter of said portion of said tube extending between said closed end and said reduced inside diameter portion is larger than said reduced inside diameter portion.

4. The apparatus of claim 1, wherein said open end has a sloped edge arranged to define a short length side and a long length side of said tube, wherein said long length side is longer than said cigarette, and said short length side is shorter than said cigarette, whereby a cigarette positioned in said tube is both protected from crushing and accessible for removal from said tube.

5. The apparatus of claim 3, wherein said tube has a further portion extending between said reduced inside diameter portion and said open end which is larger than said reduced inside diameter portion.

6. The apparatus of claim 1, wherein said reduced inside diameter portion is integrally formed in said tube.

7. The apparatus of claim 1, wherein said reduced inside diameter portion is positioned closer to said closed end of said tube than said open end of said tube.

8. The apparatus of claim 4, wherein said sloped edge is a substantially planar surface extending from said short length side to said long length side of tube.

9. The apparatus of claim 1, wherein said reduced diameter portion further comprises a larger diameter portion between said axially spaced circumferential bands, said larger diameter portion being larger then said axially spaced circumferential bands.

10. The apparatus according to claim 1, wherein said tube has a longitudinal axis extending along a length thereof, and wherein said axially spaced circumferential bands are substantially transverse to said axis.

* * * * *